United States Patent [19]

Churchward

[11] 4,085,934

[45] Apr. 25, 1978

[54] GOLF CLUB

[76] Inventor: Roy Alexander Churchward, 6444 Nineteenth Ave. South, Richfield, Minn. 55423

[21] Appl. No.: 423,080

[22] Filed: Dec. 10, 1973

Related U.S. Application Data

[63] Continuation-in-part of Ser. No. 277,739, Aug. 3, 1972, abandoned.

[51] Int. Cl.[2] ..... A63B 53/08

[52] U.S. Cl. ..... 273/171

[58] Field of Search ..... 273/77 R, 78, 164, 167–175

[56] References Cited

U.S. PATENT DOCUMENTS

| | | | |
|---|---|---|---|
| 1,213,382 | 1/1917 | Kent | 273/171 |
| 1,306,029 | 6/1919 | Robertson | 273/171 |
| 1,446,577 | 2/1923 | Nix | 273/171 |
| 1,538,312 | 5/1925 | Beat | 273/171 |
| 2,067,556 | 1/1937 | Wettlaufer | 273/171 X |
| 2,332,342 | 10/1943 | Reach | 273/174 X |
| 2,517,245 | 8/1950 | Scott | 273/171 |
| 3,466,047 | 9/1969 | Rodia et al. | 273/171 |
| 3,610,630 | 10/1971 | Glover | 273/171 |

FOREIGN PATENT DOCUMENTS

| | | | |
|---|---|---|---|
| 413,024 | 7/1934 | United Kingdom | 273/171 |
| 194,823 | 3/1923 | United Kingdom | 273/171 |

*Primary Examiner*—Richard J. Apley

[57] ABSTRACT

A golf club is disclosed including an impact block located in the head of the club. The impact block includes means for adjusting the weight and balance of the club. The impact block has a plurality of openings. Rod shaped weights are slideably inserted in said openings.

3 Claims, 10 Drawing Figures

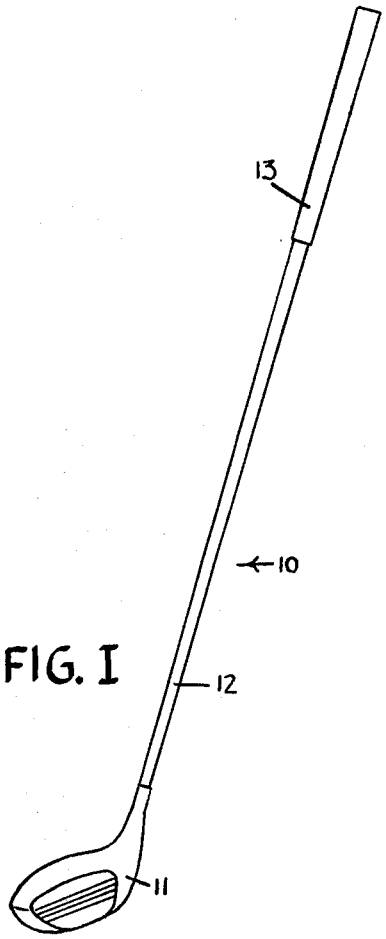
FIG. I
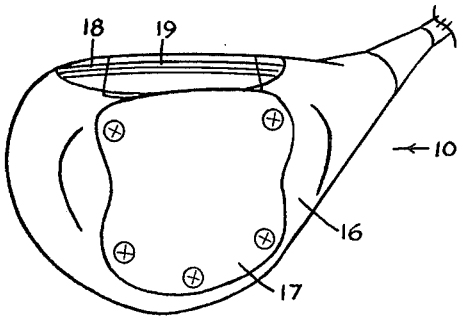
FIG. II
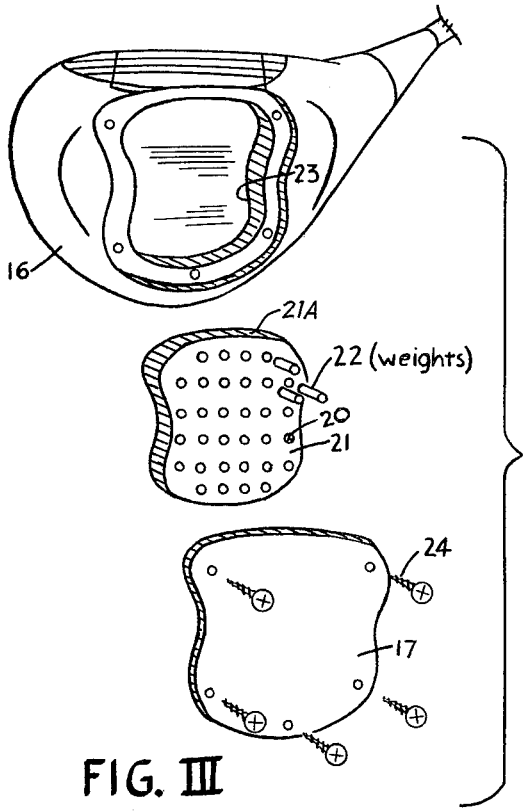
FIG. III
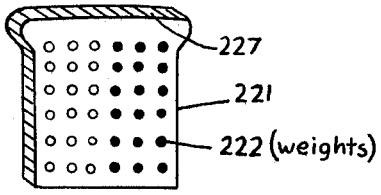
FIG. V (slice)
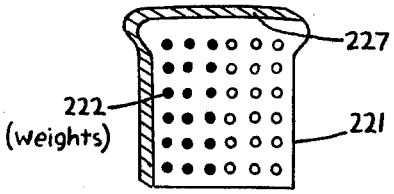
FIG. VI (hook)
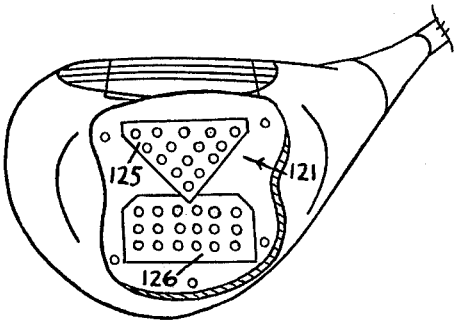
FIG. IV

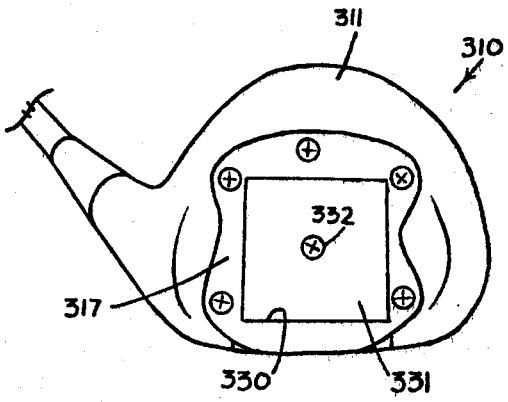
FIG. VII
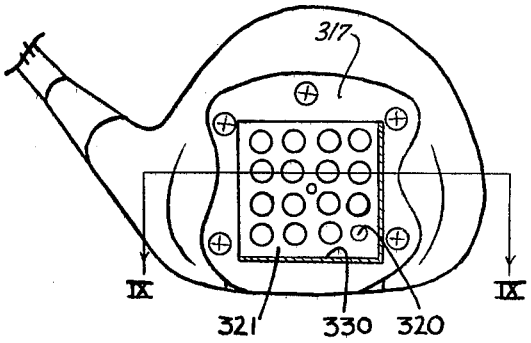
FIG. VIII
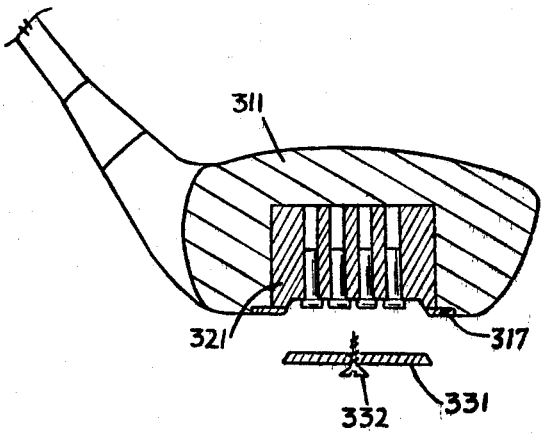
FIG. IX
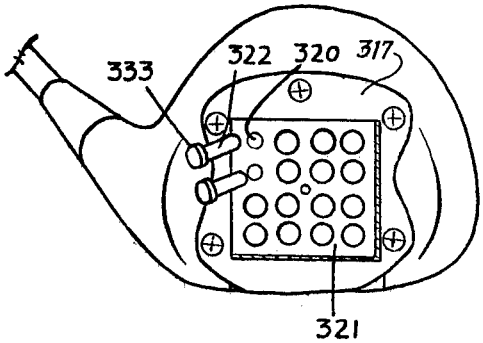
FIG. X

GOLF CLUB

This application is a continuation in part of U.S. Patent Application Ser. No. 277,739 filed Aug. 3, 1972 and now abandoned.

BACKGROUND OF THE INVENTION

The present invention relates to sporting goods and more particularly to an improved golf club.

The history of golf likely goes back to the cave man who swung a hunting club at a stone lying on the ground and decided that his hunting skills might be improved if he practiced hitting such stones. Today, however, golf is a highly sophisticated sport in which much skill may be developed.

Golf is a sport that is highly enjoyable to the expert, as well as the beginner. Both the expert and the beginner, however, experience the frustration of the curving golf ball. The ball is said to hook when the golf ball is struck by a right-handed golfer and curves to the left during flight. On the other hand, the ball is said to slice if the same golfer strikes the ball and it curves to the right. In the past much effort has been expended in order to overcome the hook or slice. For example, grips have been designed to remind the golfer that the club must be held properly to strike the ball properly. In other words, the ball must be struck such that the club face is neither excessively open (which produces a slice) or excessively closed (which produces a hook). Effort has been expended through lessons and various types of apparatus to teach the golfer proper stance and proper swing. In spite of such effort, the hook and slice continue to bother many golfers in varying degrees.

The present invention provides an improved golf club that substantially reduces or eliminates the problem of the hook or slice for most golfers.

IN THE DRAWINGS

FIG. I shows a golf club of the present invention;

FIG. II shows a perspective view of the lower side of the head of the golf club;

FIG. III shows an exploded view of the head of a golf club, including the impact block of the present invention;

FIG. IV shows another embodiment of the impact block of the present invention;

FIG. V illustrates an impact block loaded in one particular manner;

FIG. VI illustrates an impact block loaded in another particular manner;

FIGS. VII — IX show a further embodiment including a removable cover providing access to the impact block; and FIG. X shows the impact block of the embodiment of FIGS. VII — IX.

DETAILED DESCRIPTION OF THE PRESENT INVENTION

The golf club 10 of the present invention (FIG. I) includes a club head 11, a shaft 12, and a handle or grip 13. The club 10 is of the type generally called a "wood." The shaft 12 is stiff, yet flexible, and typically is made of light weight tubular spring steel. The grip 13 is applied over the upper portion of the shaft 12 and typically consists of a wrapping of leather or rubber to provide a non-slip surface.

The club head 11 of a so-called "wood" is generally constructed of wood, such as persimmon or laminated wood; however, as used herein the term "wood" will also include clubs having heads of various other materials such as plastic or nylon. The club head 11 (FIG. II) has a body portion 16, a sole plate 17, and a face 18 including a face plate 19. The face 18, as shown, is generally slightly curved. The face plate 19 is inletted into the club head 11 to provide an even surface across the face 18. The face 18 of the club head 11 may have horizontal furrows to aid in control of the golf ball. The face plate 19 provides a hard wear resistant surface for striking the ball.

The club head 11 (FIG. III) of the present invention includes an impact block 21. The term "impact block" as used herein refers to weight disposed beneath the sole plate 17. The impact block 21 may be constructed of aluminum or other light weight material, for example, magnesium. Alternatively, the impact block 21 may be of any other material such as copper. The impact block 21 has a forward surface 21A that preferably has the same curvature as the face 18 of the club head 11 and lies in an arc parallel with the face 18. The forward surface of the impact block 21 desireably is spaced within about $\frac{3}{8}$ to $\frac{1}{2}$ inch of the face of the club. It has been found that this arrangement results in a good feel and satisfying click regardless of what portion of the club face contacts the ball. It has been found that such an arrangement provides greater impact when the golf club 10 strikes a golf ball. The closer the impact block is located to the club face, the faster the ball will rebound from the club when struck. The term applied to this phenomenon is coefficient of restitution.

In other embodiments the impact block 21 may be of any desired shape and size. The impact block 21 is preferably a non-circular shape. In some instances the impact block may comprise the club head itself. This is particularly feasible when the club head is made of aluminum or nylon. The impact block 21 preferably is a matrix which has defined therein a plurality of openings 20 for reception of weights 22. The weights 22 may be of any desired size and weight; however, in one preferred embodiment each weight is equal to one lorythmic swing weight. In another preferred embodiment each weight may be equal to two lorythmic swing weights. By so doing a single club can be manufactured which at a later time can be weight-adjusted to provide, for example, a C-2 to an E-2 club. This substantially simplifies the manufacturing of golf clubs. Thus a single club may be manufactured which is capable of weight adjustment over the entire commonly used weight range. This eliminates the need for large inventories on the part of a golf pro shop.

In one embodiment the weights 22 in the impact block 21 may be cylindrical in shape. The weights 22 may have a length that is very nearly the same as the length of the openings 20 in the impact block 21. The openings 20 desireably extend entirely through or very nearly through the impact block 21. Thus the weights 22 have a length that is approximately equal to the thickness of the impact block 21. In another embodiment the openings and the weights extend only through a portion of the impact block. In this instance the impact block may be removed and inverted, thus providing both vertical and horizontal adjustment of the weights. Alternatively, the cylindrical weights may be a composite of two materials. In other words, one portion or end of the weight may be made of a heavy material such as copper and another portion or end of the weight may be light weight such as polyethylene. The weight may be inserted with the heavy end down or alternatively with the heavy end up. This provides for vertical as well as horizontal adjustment of the weights. The weights 22 are slideably received in the openings 20 and not threadably engaged. Such slideable reception provides very significant advantage over threaded engagement. For example, adjustment of the amount of weight or location of weights may be quickly and easily adjusted. Threaded screws, on the other hand, are very slow and somewhat difficult to change. The screws and screw slots may be stripped. Such problems are not encountered in the present invention. The present impact block 21 and weights 22 may be simply and efficiently manufactured. The impact block 21 may be manufactured from a metal block simply by drilling or punching the openings in the block. Threading such openings would make such manufacture complicated and expensive. The weights 22 may simply be metal rod material cut to the appropriate length. The rod material may be standard copper rod which is readily and widely available. Further, no special tools are necessary to either manufacture or change such weights.

The openings 20 may be in a grouped array such that the golfer may recall which openings he normally has filled with weights 22 thus giving the individual golfer a base point from which to adjust the weight locations. The openings 20 are preferably a series of aligned openings. The grouped array may be at least four rows of openings, each row having at least four openings.

The club head 11 has a cavity 23 defined therein for snug reception of the impact block 21. In the assembled club 10, the impact block 21 fits just beneath the sole plate 17 which in turn is secured to the club head 11 such as by screws 24. The impact block 21 and weights 22 are held in place by the sole plate 17 and is substantially covered by such plate.

The impact block 21 desireably has a low horizontal profile and is located close to the sole plate 17 so that the center of gravity is lowered in the club head 11 thus lowering the so-called "sweet spot" or ideal area of impact on the face of the club. The impact block 21, for example, may be disposed in the lower 25% of the club head 11. The impact block 21 may be a copper bar stock having a thickness of about 3/16 inches. Such lowering of the "sweet spot" and/or low horizontal profile of the impact block creates greater velocity in the club head without increasing the golfer's normal swing and therefore greater distance.

The club 110, shown in FIG. IV, has an impact block 121 including two pieces. The forward portion 125 of impact block 121 is triangular in shape. The rear portion 126 of impact block 121 may be rectangular in shape. Both the forward portion 125 and the rear portion 126 may be provided with openings for reception of weights as discussed with respect to impact block 21. The design of the impact block 121 is well suited for use in nearly all of the clubs commercially available. The shape is such that the impact block 121 avoids the areas where the screws are located for holding the sole plate in place.

Another embodiment of the impact block 221 of the present invention is shown in FIGS. V and VI. The impact block 221 has a forward surface 227 which has a curvature closely approximating the curvature of the face of the golf club (not shown). The impact block 221 is provided with a plurality of weights 222. The impact block 221 as shown in FIG. V is loaded such that it tends to reduce or eliminate a slice. In other words, the impact block 221 in FIG. V is loaded toward the heel of the club to overcome a slice. An impact block 221, as shown in FIG. VI, is loaded such that it tends to reduce or eliminate a hook. The impact block 221 (FIG. VI) thus is loaded toward the toe of the club to overcome a hook. The impact block 221 may be weighted toward the rear of the club head which enlarges the "sweet spot" for golfers that are somewhat irregular in hitting the ball. The impact block 221, alternatively, may be weighted toward the face of the club which narrows the "sweet spot," thus concentrating the force of the club when striking the ball. The impact block 221 may be weighted toward both the heel and the toe with the block acting as a bridge therebetween. The latter arrangement results in less loss of force when one strikes the ball off the center of the club face.

A further embodiment 310 of the present invention is shown in FIGS. VII – X. The golf club 310 has a sole plate 317 which substantially covers the bottom of the club head 311. The sole plate 317 has an opening 330 therein, which provides access to all of the weight receiving openings 320 without removal of the sole plate 317. The impact block 321 is somewhat larger than the opening 330 and thus is held in place in the club head 311 by the sole plate 317. The opening 330 is covered by a removable cap 331. The cap 331 is normally held in place by a screw 332 which is threadedly engaged in the impact block 321. In this embodiment the weighting may be changed simply by removing the screw 332 and then the cap 331. The weights 322 in this embodiment have an enlarged head portion 333 and may be removed by grasping the head portion 333 with one's fingernails and withdrawing the weight. The weight may then be inserted in another of the openings 320. The cap 331 then may be again secured in place with screw 332.

The embodiment of the invention in which an exclusive property or privilege is claimed are defined as follows:

1. A golf club comprising a shaft, a grip disposed at one end of said shaft and a club head disposed at the other end of said shaft, said club head including a body portion, an impact block means disposed in said body portion and a sole plate, said sole plate substantially covering the bottom of said club head, said impact block means having defined therein a plurality of openings and a plurality of weights disposed in selected ones of said openings, said weights being cylindrical in shape and being slideably inserted in said openings, the axis of said cylindrical weights being perpendicular to said sole plate, said weights extending only through a portion of said impact block means and said impact block means being invertable to raise and lower the weights in said club head.

2. A golf club comprising a shaft, a grip disposed at one end of said shaft and a club head disposed at the other end of said shaft, said club head having defined therein a cavity and a sole plate substantially covering the bottom of said club head, said club head having an impact block snugly disposed in said cavity, said impact block being a flat non-circular block extending longitudinally substantially across the bottom of said club head, said block having a thickness of about 3/16 inches and being disposed in the lower 25% of the club head, said impact block having a matrix including a grouped array of openings, said grouped array comprising at least four rows of openings, each of said rows including at least four openings, a plurality of weights disposed in selected ones of said openings, said weights comprising rods, said rods being slideably inserted in said openings with the axis of said rods extending perpendicular with respect to said sole plate, said weights having a length approximately equal to the thickness of said block.

3. The golf club of claim 2 wherein the magnitude of each of said weights is one lorythmic swing weight.

* * * * *